US005365319A

United States Patent [19]

Sakemi et al.

[11] Patent Number: 5,365,319

[45] Date of Patent: Nov. 15, 1994

[54] IMAGE FORMING APPARATUS REPLENISHING TONER BY DETECTING THE RATIO OF TONER AND CARRIER AND THE DENSITY OF THE DEVELOPER

[75] Inventors: Yuji Sakemi, Inagi; Masami Izumizaki, Yokohama, both of Japan

[73] Assignee: Canon Kabushiki Kaisha, Tokyo, Japan

[21] Appl. No.: 25,177

[22] Filed: Mar. 2, 1993

[30] Foreign Application Priority Data

Mar. 5, 1992 [JP] Japan ..... 4-83445

[51] Int. Cl.[5] ..... G03G 21/00

[52] U.S. Cl. ..... 355/246; 118/688; 355/208

[58] Field of Search ..... 355/203, 208, 214, 246; 118/688-691

[56] References Cited

U.S. PATENT DOCUMENTS 4,226,525 10/1980 Sakamoto et al. ..... 118/689 X
4,589,762 5/1986 De Schamphelaere et al. ... 118/689 X
4,942,431 7/1990 Tada ..... 355/246
4,969,011 11/1990 Faull et al. ..... 355/208
5,057,870 10/1991 Aoki ..... 355/246
5,081,498 1/1992 Bares ..... 355/246
5,124,751 6/1992 Fukui et al. ..... 355/246
5,142,332 8/1992 Osawa et al. ..... 355/208
5,146,274 9/1992 Hattori et al. ..... 355/208

*Primary Examiner*—A. T. Grimley
*Assistant Examiner*—William J. Royer
*Attorney, Agent, or Firm*—Robin, Blecker, Daley & Driscoll

[57] ABSTRACT

The present invention provides an image forming apparatus wherein first information corresponding to toner density of two-component developer including toner and carrier particles is detected by a first sensor, second information corresponding to density of the two-component developer is detected by a second sensor, and an amount of toner to be replenished to the two-component developer is controlled on the basis of outputs of the first and second sensors.

11 Claims, 3 Drawing Sheets

IMAGE FORMING APPARATUS REPLENISHING TONER BY DETECTING THE RATIO OF TONER AND CARRIER AND THE DENSITY OF THE DEVELOPER

BACKGROUND OF THE INVENTION

1. Field of the Invention

The present invention relates to an image forming apparatus such as a copying machine, a printer and the like, which is of electrophotographic type or electrostatic recording type wherein an electrostatic latent image formed on an image bearing member is visualized by developing it with toner, and more particularly, it relates to an image forming apparatus having a toner density control means for properly controlling toner density or toner concentration of two-component developer comprised of toner, and carrier particles for applying frictional charge to the toner.

2. Related Background Art

As is well-known, the toner density of the two-component developer (i.e., rate of toner weight with respect to the total weight of the mixture of the carrier particles and the toner) is very important for stabilizing image density and image quality. The toner in the developer is consumed during the developing operation, thereby changing the toner density. Thus, the use of a toner density control device is required to properly detect the toner density at any time, to replenish new toner in the developer in accordance with the change in the toner density and to always keep the toner density constant.

In conventional toner density control devices, an optical detection system for detecting the toner density by detecting an amount of light reflected from the developer, an inductance detection system for detecting the toner density by detecting inductance of the developer, or a capacity detection system for detecting the toner density by detecting electrostatic capacity of the developer has been used. However, in such conventional toner density control devices, since indirect information such as the reflected light amount or inductance of the developer was used, it was impossible to detect the correct toner density of the developer.

For example, when the amount of light reflected from the developer is detected, although the reflected light amount is varied in accordance with the change in the toner density of the developer, it is also varied in accordance with the change in density of the developer. Particularly, when the developer including toner having the larger building-up change in its frictional charging charge is used, although the density of the developer in a developer container is initially high, during the continuous formation of images, the density of the developer will become rough gradually as the frictional charge of the toner is being built-up, with the result that the reflected light amount will be decreased even if the toner density is constant (not varied). Consequently, the toner density control device will judge as if the toner density is decreased, and, thus, replenish new toner to the developer, with the result that the actual toner density will be increased.

In the above, while the optical detection system for detecting the amount of light reflected from the developer was described, also in the conventional detection systems for indirectly detecting the toner density of the developer (for example, inductance detection system), since they are apt to be influenced upon the change in the density of the developer (other than the change in the toner density), the correct toner density of the developer cannot be detected, thus making the control of the toner density with high accuracy difficult or impossible.

SUMMARY OF THE INVENTION

An object of the present invention is to provide an image forming apparatus which can control toner density with high accuracy.

Another object of the present invention is to provide an image forming apparatus which can correctly detect toner density of two-component developer and control the toner density with high accuracy.

An image forming apparatus according to the present invention comprises first detection means for acting on developer including toner and carrier particles to detect first information corresponding to toner density of the developer, second detection means for detecting second information corresponding to density of the developer, and control means for controlling the activation of a toner replenishing means on the basis of output signals from the first and second detection means.

The other objects and features of the present invention will be apparent from the following descriptions.

DETAILED DESCRIPTION OF THE PREFERRED EMBODIMENTS

Figure 1:
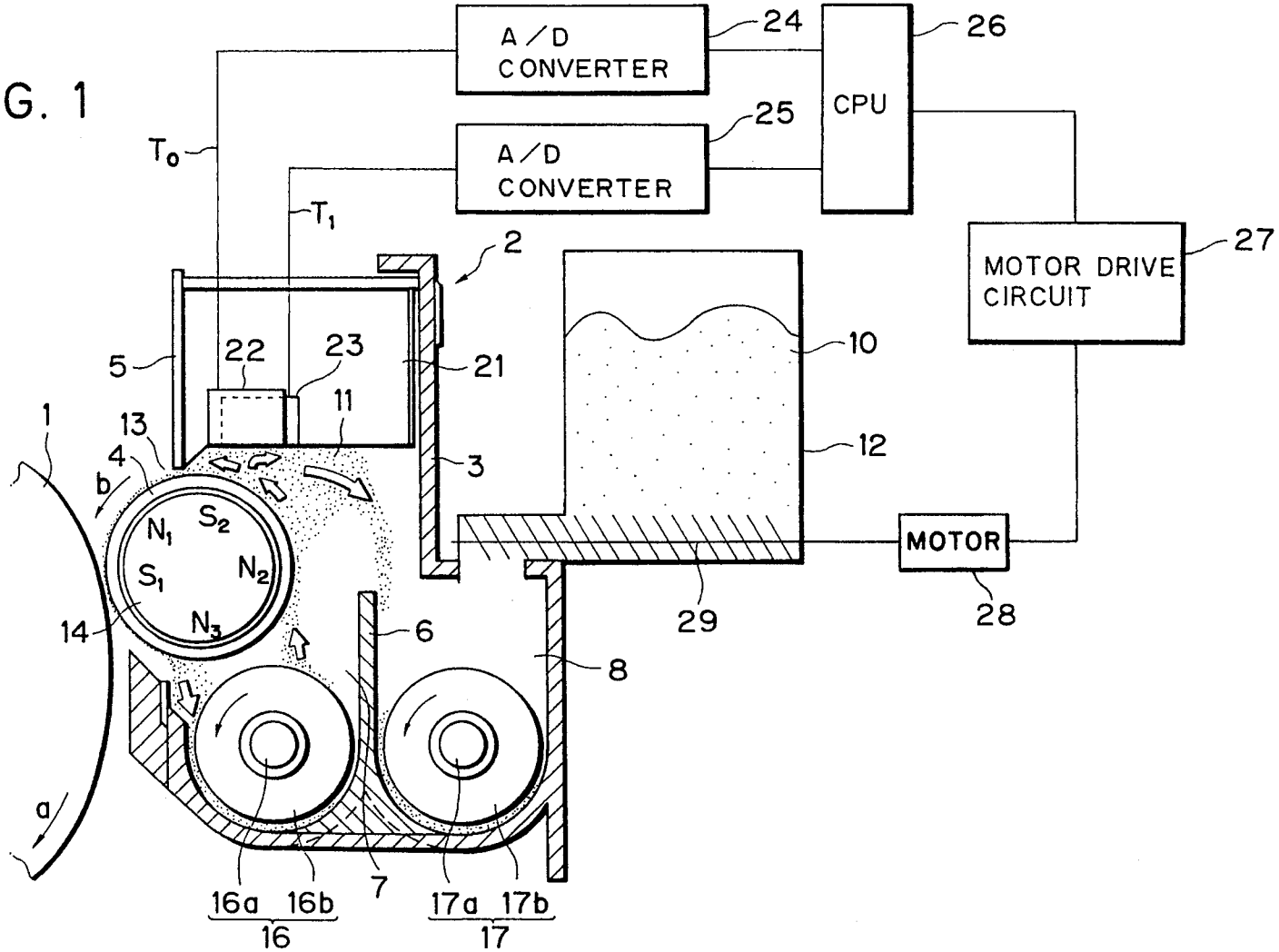
FIG. 1 is a view showing an image forming apparatus according to an embodiment of the present invention.

FIG. 1 is a schematic constructural view showing a main portion of an image forming apparatus according to a preferred embodiment of the present invention. An image forming apparatus according to the present invention is designed so that an electrostatic latent image formed on an image bearing member 1 such as an electrophotographic photosensitive member, dielectric member or the like by an electrophotographic method, electrostatic method or the like is developed by a developing device 2 as a visualized image and the visualized image is transferred onto a transfer sheet such as a paper sheet, and the transferred image is fixed by a fixing device as a permanent image. Since the whole construction of such image forming apparatus is well-known in the art, FIG. 1 shows only the image bearing member 1 and the developing device 2 relating to the present invention, and a latent image forming means, transfer means, transfer sheet supply means, fixing means and other image forming means are omitted from illustration.

As shown in FIG. 1, the developing device 2 opposed to the image bearing member 1 rotated in a direction shown by the arrow comprises a developer container 3, a developing sleeve (developer carrying member) 4, and a blade (developer layer thickness regulating member) 5. The interior of the developer container 3 is divided into a developing chamber (first chamber) 7 and an agitating chamber (second chamber) 8 by a partition wall 6. Above an upper end of the partition wall 6, there is provided a passage through which excessive two-component developer in the developing chamber 7 is shifted into the agitating chamber 8. In this embodiment, the two-component developer 11 including non-magnetic toner and magnetic carrier particles is contained in the developing chamber 7 and the agitating chamber 8.

First and second developer agitating and conveying means 16, 17 of screw type are disposed in the developing chamber 7 and the agitating chamber 8, respectively. The first developer agitating and conveying means 16 serves to agitate and convey the developer in the developing chamber 7, and the second developer agitating and conveying means 17 serves to agitate toner 10 supplied toward an upstream side of the second developer agitating and conveying means 17 from a toner containing bath 12 under the control of a toner density control device (which will be described later) with the developer already contained in the agitating chamber 8, thereby making the toner density uniform. Developer passages (not shown) are formed at this side (FIG. 1) and that side of the partition wall 6, which communicate between the developing chamber 7 and the agitating chamber 8, so that the developer in the developing chamber 7 the toner density of which is decreased by the consumption of the toner during the developing operation is shifted from the chamber 7 to the agitating chamber 8 through one of the developer passages and the developer the toner density of which is restored in the agitating chamber 8 is shifted from the chamber 8 to the developing chamber 7 through the other developer passage, by the conveying forces of the developer agitating and conveying means 16, 17.

Figure 2:
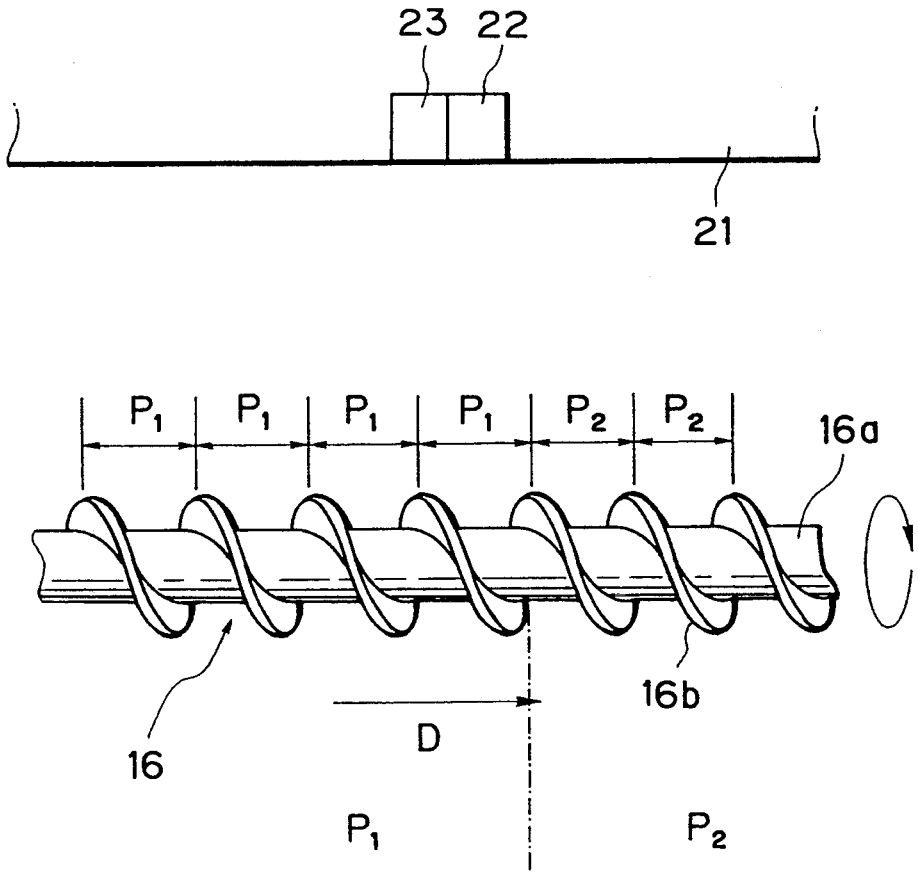
FIG. 2 is a view showing a positional relation between a developer agitating and conveying means and two sensors used with the apparatus of FIG. 1.

The first agitating and conveying means 16 of screw type is arranged at the bottom of the developing chamber 7 substantially in parallel with an axial direction (developing width direction) of the developing sleeve 4. In the illustrated embodiment, as shown in FIG. 2, the agitating and conveying means 16 has a screw configuration comprising a rotary shaft 16*a* and a spiral blade 16*b* arranged around the shaft, which screw is rotated in a direction shown by the arrow and serves to convey the developer 11 in the developing chamber 7 in one direction D along the axial direction of the developing sleeve 4 at the bottom of the developing chamber 7. The second agitating and conveying means 17 has the same construction as the first agitating and conveying means 16 (i.e., comprising a rotary shaft 17*a* and a spiral blade 17*b* arranged around the shaft and having the orientation opposite to that of the blade 16*b*) and is arranged at the bottom of the agitating chamber 8 substantially in parallel with the first agitating and conveying means 16, so that it is rotated in the same direction as the first agitating and conveying means 16 to convey the developer 11 in the agitating chamber 8 in a direction opposite to the developer conveyed by the first agitating and conveying means 16. In this way, the developer 11 is circulated between the developing chamber 7 and the agitating chamber 8 by the rotation of the first and second agitating and conveying means 16, 17.

The developing sleeve 4 is rotatably supported within an opening 13 formed in the developing chamber 7 of the developing container 3. The developing sleeve 4 is made of non-magnetic material and is rotated in a direction b during the developing operation, and a magnet 14 is fixed within the developing sleeve. The developing sleeve 4 serves to carry a layer of the two-component developer a thickness of which is regulated by the non-magnetic blade 5 and to supply the developer to the image bearing member 1 at a developing area between the image bearing member and the developing sleeve, thereby developing the latent image. In order to improve the developing efficiency i.,e, rate of application of toner to the latent image, a developing bias voltage obtained by overlapping a DC voltage with an AC voltage is applied to the developing sleeve 4 from a power source (not shown).

In the illustrated embodiment, the magnet 14 has a developing magnetic pole $S_1$, and magnetic poles $N_1$, $S_2$, $N_2$, $N_3$ for conveying the developer 11. The developer 11 in the developing chamber 7 is carried by the developing sleeve 4 by the action of the magnet 14 incorporated within the developing sleeve 4, and is fed to the developing area after the thickness of the layer of the developer has been regulated by the blade 5. The developer remaining on the developing sleeve (which has not been used during the developing operation) is returned to the developing chamber 7 again by the developing sleeve 4, and is dropped from the developing sleeve 4 into the developing chamber by the repulsion magnetic fields generated by the magnetic poles $N_3$, $N_2$ having the same polarity.

On the other hand, the developer agitated by the rotation of the first agitating and conveying means 16 is picked up onto the developing sleeve by the magnetic pole $N_2$ and is conveyed to the layer thickness regulating station. The layer thickness regulating station includes the aforementioned blade 5, and a developer guide member 21 opposed to the developing sleeve 4 and disposed in front of the blade 5 with respect to the rotational direction of the sleeve.

At the developer guide member 21, the developer moves as shown and is divided into a developer portion fed from the layer thickness regulating station to the developing area and a developer portion pushed back by the guide member 21 and dropped into the agitating chamber 8. The developer dropped into the agitating chamber 8 is mixed with the developer which has been mixed with new replenished toner in the agitating chamber 8, and is fed toward the developing chamber 7.

In FIG. 1, first and second sensors 22 and 23 are provided in the developer guide member 21 and are opposed to the developer on the developing sleeve 4. In FIG. 1, while the second sensor 23 was disposed that side of the first sensor 22 with respect to the axial direction of the developing sleeve 4, it may be disposed this side of the first sensor. Further, in FIG. 1, while the first sensor 22 was slightly offset toward the downstream side more than the second sensor 23 with respect to the rotational direction of the sleeve 4, it may be offset less than the second sensor or may be offset as same as the second sensor with respect to the rotational direction of the sleeve.

By the way, in FIG. 1, the first sensor 22 is a conventional reflected light amount detection sensor wherein light such as infrared light emitted from a light source such as an LED and the like is illuminated on the developer and the light reflected from the developer is received by a light receiving element such as a photodiode, thereby obtaining an electric signal corresponding to the reflected light amount.

The reflected light amount is varied or changed in accordance with the change in the toner density in the developer. That is, the higher the toner density the greater the reflected light amount, whereas, the lower the toner density the smaller the reflected light amount. Thus, the reflected light amount, i.e., the output of the first sensor 22 is proportional to the toner density in the developer.

However, the reflected light amount is also changed in accordance with the density of the developer itself. As shown in FIG. 1, in a condition that an area near the reflected light amount detection sensor 22 is filled with the developer 11 and the excessive developer is returned toward the agitating chamber 8 by the guide member 21, it is possible to suppress the change in the density of the developer near the reflected light amount detection sensor 22 to a smaller extent, with the result that the sensor 22 is almost not influenced upon the change in the density of the developer. However, although the influence of the change in the density of the developer upon the sensor 22 is small, the output of the sensor 22 is influenced upon the change in the density of the developer more or less.

Thus, in the illustrated embodiment, in order to detect the density of the developer near the reflected light amount detection sensor 22, the second detection sensor (referred to as "developer density detection sensor" hereinafter) 23 having the detection system different from that of the reflected light amount detection sensor 22 is arranged in the vicinity of the reflected light amount detection sensor 22, so that the toner density information of the developer obtained on the basis of the reflected light amount detected by the reflected light amount detection sensor 22 is corrected on the basis of the output of the developer density detection sensor 23 to calculate the correct toner density value while eliminating the influence of the change in the density of the developer, thereby controlling the toner density in the developer with high accuracy. In the illustrated embodiment, the developer density detection sensor 23 comprises a conventional inductance sensor which detects inductance of the developer carried and conveyed by the developing sleeve 4 and outputs an electric signal corresponding to the detected inductance.

With this arrangement, since the reflected light amount detection sensor 22 detects the amount of light reflected from the toner of the developer, it is possible to detect the content of the toner per unit area. Accordingly, when the density of the developer becomes smaller, since the amount of light reflected from the developer is decreased, the sensor 22 detects as if the toner density in the developer is decreased.

To the contrary, since the developer density detection sensor 23 for detecting the inductance of the developer detects the permeability of the carrier in the developer, it is possible to detect the content of the carrier per unit volume. Accordingly, when the density of the developer becomes smaller, the sensor 23 detects the fact that the inductance becomes smaller (In other words, when the density of the developer becomes smaller, the sensor 23 detects as if the toner density in the developer is increased).

In this way, in the toner density control device according to the illustrated embodiment, since two detection means (sensors) having the different detection system are used, it is possible to know the change in the toner density in the developer and the change in the density of the developer.

Normally, when the optical detection sensor 22 detects the toner density to the smaller extent by $-\Delta T$ %, the inductance detection sensor 23 will detect the toner density to the greater extent by $\alpha \times \Delta T$ %. Where, $\alpha$ is a predetermined constant which is determined by the developer and the circumstances. Therefore, when the detected value from the optical detection sensor 22 is $T_0$ and the detected value from the inductance detection sensor 23 is $T_1$, the apparent change $\Delta T$ in the toner density due to the change in the density of the developer will be as follows:

$$\Delta T=(T_1-T_0)/(1+\alpha) \quad (1)$$

Accordingly, the toner density is determined by adding the correction value $\Delta T$ % corresponding to the change in the density of the developer to the detected value $T_0$ % of the optical detection sensor; that is, the toner density will be as follows:

$$[T_0+\{(T_1-T_0)/(1+\alpha)\}]\% \quad (2)$$

So, when an amount of toner according to the difference between this toner density and the initially set reference toner density is added or replenished to the developer, it is possible to control the toner density without the influence of the density of the developer. When such control was adopted to a color image forming apparatus of electrophotographic type, it was found that a very fine full-color image could be obtained with stable image density and image quality for a long time.

In FIG. 1, the output signal $T_0$ from the first sensor 22 is sent to a central processing unit (CPU) 26 via an A/D converter 24. Similarly, the output signal $T_1$ from the second sensor 23 is sent to the CPU 26 via an A/D converter 25.

The CPU 26 calculates the toner density on the basis of the above formula (2) by using the detected values $T_0$ and $T_1$, and activates a motor 28 via a motor drive circuit 27 on the basis of the difference between the calculated toner density and the reference toner density. The motor 28 is rotated for a time corresponding to the above difference or at a speed corresponding to the above difference to rotate a screw 29 for feeding toner 10 from the toner containing bath 12 to the agitating chamber 8 of the developer container.

Incidentally, in the illustrated embodiment, as shown in FIG. 2, the pitch of the spiral of the spiral blade **16*b* of the first agitating and conveying means 16 is changed from $P_1$ (for example, 17 mm) to $P_2$ (for example, 15 mm) from half way of the first agitating and conveying means 16 toward the downstream side thereof, and the developer density detection sensor 23 of inductance detection type and the reflected light amount detection sensor 22 of optical detection type are disposed at an upstream side of the transition area between the different pitches with respect to the developer feeding direction D. This is the reason why the feeding speed of the developer 11 is decreased by reducing the pitch of the spiral screw blade to stay the developer 11 at the transition area, thereby stabilizing the density of the developer to some extent at that transition area. In this way, it is possible to prevent the fluctuation of the outputs of the developer density detection sensor 23 and the reflected light amount detection sensor 22, thereby detecting the change in toner density of the developer 11 and the change in the density of the developer stably. Of course, it should be noted that the above construction is not inevitable, and, the construction of the agitating and conveying means and/or positions of the reflected light amount detection sensor 22 and the developer density detection sensor 23** may be altered at need.

Figure 3:
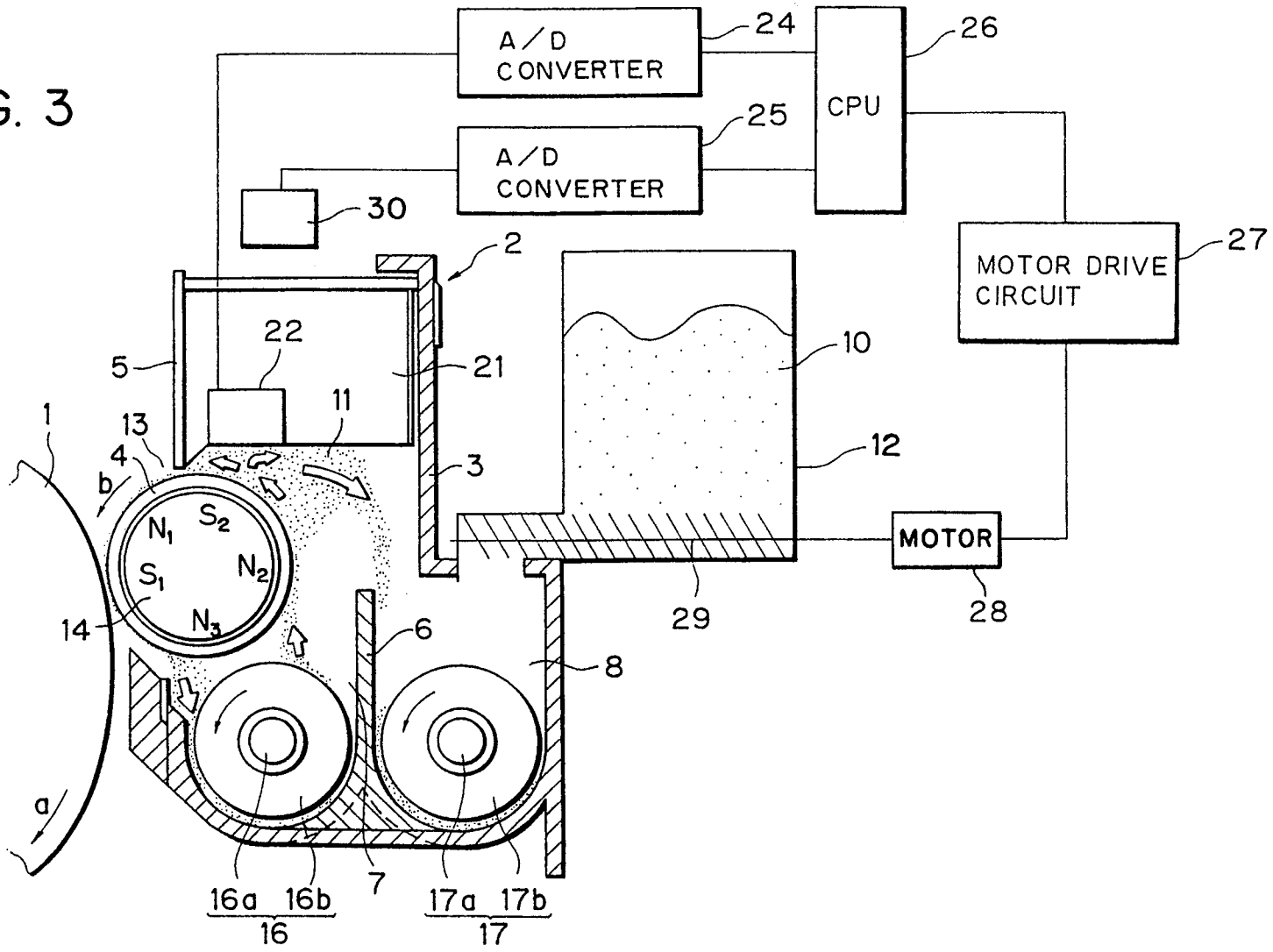
FIG. 3 is a view showing an image forming apparatus according to another embodiment of the present invention.

FIG. 3 shows another embodiment of the present invention wherein, in place of the developer density detection sensor 23 of inductance detection type according to the first embodiment, a conventional humidity sensor 30 for outputting an electric signal corresponding to the humidity is used. Since the other construction is same as that of the first embodiment, the same constructural elements will be designated by the same reference numerals and the detailed explanation thereof will be omitted.

Since the density of the developer is influenced upon an amount of the frictional charge of the toner and the carrier particles, if the humidity is low, the density of the developer is apt to be decreased; whereas, if the humidity is high, the density of the developer tends to be increased. However, the absolute value of the density of the developer differs from one developer to the other. Thus, a table for corresponding the change in the density of the developer to the humidity is stored in memory of the CPU 26, so that the density of the developer can be obtained on the basis of the humidity information from the humidity sensor 30. The CPU 26 corrects the toner density information of the developer detected by the reflected light amount detection sensor 22 of optical detection type. That is to say, the CPU 26 can calculate the toner density value of the developer with high accuracy by adding the correction value $\Delta T$ on the basis of the read value from the humidity sensor 30 to the read value $T_1$ from the reflected light amount detection sensor 22. The CPU 26 activates the motor 28 via the motor drive circuit 27 in accordance with the difference between the calculated toner density and the reference toner density.

In this way, also in this embodiment, it is possible to control the toner density with high accuracy and without the influence of the change in the density of the developer.

Incidentally, the humidity sensor 30 is disposed within the image forming apparatus, and is preferably disposed in the vicinity of or within the developer container 3 in order to correspond the detected value thereof to the density of the developer in the developer container more correctly.

Further, since the density of the developer tends to be decreased by agitating the initial developer by the agitating and conveying means 16, 17 rotated in synchronous with the rotation of the developing sleeve 4, a counter is provided for counting the number of revolutions of the developing sleeve 4 and a relation between the output value of the counter and the density of the developer is previously stored in the CPU, so that the CPU can output the correction value $\Delta T$ for the change in the density of the developer in accordance with the output value of the counter to correct the density information of the developer from the reflected light amount detection sensor 22 of optical detection type, thereby controlling the toner density with high accuracy as in the previous embodiments. Incidentally, the correction on the basis of the output value of the counter may be added to the aforementioned first or second embodiment to control the toner density of the developer with higher accuracy.

Further, when the humidity sensor or the counter for counting the number of revolutions of the sleeve is used as the means for detecting the information corresponding to the density of the developer, the above-mentioned detection sensor for detecting the inductance of the developer may be used as the means for detecting the information corresponding to the toner density of the developer.

What is claimed is:

1. An image forming apparatus comprising:

a developer container for containing developer including toner and magnetic carrier particles;

a developer carrying member for feeding out the developer from said developer container and for developing an electrostatic latent image;

toner replenishing means for replenishing toner to said developer container;

first detection means for detecting first information corresponding to ratio of the carrier and the toner;

second detection means for detecting second information corresponding to density of the developer in the developer container; and control means for controlling the operation of said toner replenishing means on the basis of output signals from said first and second detection means.

2. An image forming apparatus according to claim 1, wherein said first detection means detects light reflected from the developer.

3. An image forming apparatus according to claim 2, wherein said second detection means detects the permeability of the developer.

4. An image forming apparatus according to claim 2, wherein said second detection means detects humidity.

5. An image forming apparatus according to claim 2, wherein said second detection means detects the number of revolutions of said developer carrying member.

6. An image forming apparatus according to claim 1, wherein said second detection means detects the permeability of the developer.

7. An image forming apparatus according to claim 1, wherein said first detection means detects the permeability of the developer.

8. An image forming apparatus according to claim 7, wherein said second detection means detects humidity.

9. An image forming apparatus according to claim 7, wherein said second detection means detects the number of revolutions of said developer carrying member.

10. An image forming apparatus according to claim 1, wherein said second detection means detects humidity.

11. An image forming apparatus according to claim 1, wherein said second detection means detects the number of revolutions of said developer carrying member.

* * * * *

UNITED STATES PATENT AND TRADEMARK OFFICE

CERTIFICATE OF CORRECTION

PATENT NO. : 5,365,319

DATED : November 15, 1994

INVENTOR(S) : Yuji Sakemi et al.

It is certified that error appears in the above-identified patent and that said Letters Patent is hereby corrected as shown below:

Col. 1, line 58. Delete "as".

Col. 3, line 48. Change "the" (2nd occurrence) to --an--.

Col. 4, line 4. Change "i.,e, to -- i.e., --.

Col. 5, line 22. Change "the" to -- an --.

Col. 5, line 48. Change "To the contrary" to -- Conversely --.

Col. 6, line 23. Change "adopted" to -- adapted --.

Col. 7, line 7. After "is" insert -- the --.

Col. 7, line 46, change "nous" to -- nism --.

Signed and Sealed this

Twenty-eight Day of March, 1995

*Attest:*

*Attesting Officer*

BRUCE LEHMAN

*Commissioner of Patents and Trademarks*